US008984767B2

(12) United States Patent
Grunert et al.

(10) Patent No.: US 8,984,767 B2
(45) Date of Patent: Mar. 24, 2015

(54) LAUNDRY DRYING UNIT HAVING A LINT SCREEN ARRANGED WITHIN A PROCESS AIR CIRCUIT AND A METHOD FOR OPERATING SAID LAUNDRY DRYING UNIT

(75) Inventors: Klaus Grunert, Berlin Reinickendorf (DE); Guido Sattler, Falkensee (DE)

(73) Assignee: BSH Hausgeräte GmbH, Munich (DE)

( * ) Notice: Subject to any disclaimer, the term of this patent is extended or adjusted under 35 U.S.C. 154(b) by 729 days.

(21) Appl. No.: 13/203,262

(22) PCT Filed: Feb. 19, 2010

(86) PCT No.: PCT/EP2010/052082

§ 371 (c)(1),
(2), (4) Date: Aug. 25, 2011

(87) PCT Pub. No.: WO2010/102892

PCT Pub. Date: Sep. 16, 2010

(65) Prior Publication Data

US 2011/0302967 A1 Dec. 15, 2011

(30) Foreign Application Priority Data

Mar. 13, 2009 (DE) ..... 10 2009 001 548

(51) Int. Cl.
*F26B 21/06* (2006.01)
*D06F 58/22* (2006.01)

(52) U.S. Cl.
CPC ..... *D06F 58/22* (2013.01)
USPC ..... 34/407; 34/423; 34/138; 34/601; 34/610; 68/5 R; 68/20

(58) Field of Classification Search
USPC ..... 34/381, 407, 409, 411, 423, 80, 90, 34/138, 601, 606, 610; 68/5 C, 5 R, 19, 20; 134/18; 15/88.4, 302, 21.1; 8/158; 4/223, 233, 321, 323
See application file for complete search history.

(56) References Cited

U.S. PATENT DOCUMENTS

| | | | | |
|---|---|---|---|---|
| 2,742,708 | A | | 7/1952 | McCormick |
| 2,843,943 | A | | 7/1958 | Geldhof et al. |
| 3,083,557 | A | * | 4/1963 | Decatur ..... 68/20 |
| 3,103,112 | A | * | 9/1963 | Behrens et al. ..... 68/18 R |
| 3,572,553 | A | | 3/1971 | Ogden |

(Continued)

FOREIGN PATENT DOCUMENTS

| | | |
|---|---|---|
| CN | 1609326 | 4/2005 |
| CN | 1609326 A | 4/2005 |

(Continued)

OTHER PUBLICATIONS

International Search Report PCT/EP2010/052082.

(Continued)

*Primary Examiner* — Steve M Gravini
(74) *Attorney, Agent, or Firm* — Nixon & Vanderhye, P.C.

(57) ABSTRACT

A laundry drying unit includes a process air circuit and a component arranged in the process air circuit. Provided above the component is a washing tank for dispensing a cleaning fluid, with a flow of cleaning fluid dispensed from the washing tank to the component being controlled by a controllable valve. The valve can be controlled on the basis of an amount of cleaning fluid in the washing tank.

15 Claims, 2 Drawing Sheets

(56) References Cited

U.S. PATENT DOCUMENTS

| | | | | |
|---|---|---|---|---|
| 3,650,281 | A | 3/1972 | Hurst | |
| 3,650,821 | A | 3/1972 | Meiser | |
| 4,069,521 | A | 1/1978 | Aleman | |
| 4,345,343 | A | 8/1982 | Shipman | |
| 4,635,824 | A | 1/1987 | Gaunt et al. | |
| 4,653,200 | A * | 3/1987 | Werner | 34/82 |
| 4,743,933 | A | 5/1988 | Rentschler | |
| 4,891,892 | A * | 1/1990 | Narang | 34/86 |
| 5,050,259 | A * | 9/1991 | Tsubaki et al. | 8/159 |
| 5,104,165 | A | 4/1992 | Anderson et al. | |
| 5,148,768 | A | 9/1992 | Hinton | |
| 5,272,781 | A | 12/1993 | Bastin et al. | |
| 5,345,957 | A | 9/1994 | Cooper et al. | |
| 5,505,593 | A | 4/1996 | Hartley et al. | |
| 5,706,588 | A * | 1/1998 | Dausch et al. | 34/327 |
| 5,719,553 | A | 2/1998 | Lamparter | |
| 6,042,028 | A | 3/2000 | Xu | |
| 6,308,760 | B1 | 10/2001 | Finzo et al. | |
| 7,213,349 | B1 * | 5/2007 | Brunner | 34/86 |
| 7,412,853 | B2 * | 8/2008 | Hong et al. | 68/19.1 |
| 8,266,814 | B2 | 9/2012 | Grunert et al. | |
| 2002/0145008 | A1 | 10/2002 | Jones et al. | |
| 2003/0029705 | A1 | 2/2003 | Qiu et al. | |
| 2004/0162149 | A1 | 8/2004 | Bayer et al. | |
| 2005/0066538 | A1 | 3/2005 | Goldberg et al. | |
| 2005/0132593 | A1 | 6/2005 | Doh et al. | |
| 2006/0125284 | A1 | 6/2006 | Kristi | |
| 2006/0145793 | A1 | 7/2006 | Ning et al. | |
| 2006/0159519 | A1 | 7/2006 | Schluter et al. | |
| 2006/0179676 | A1 | 8/2006 | Goldberg et al. | |
| 2006/0272359 | A1 | 12/2006 | Kang | |
| 2007/0113327 | A1 * | 5/2007 | Denkewicz et al. | 4/213 |
| 2008/0068772 | A1 | 3/2008 | Kubo et al. | |
| 2009/0320312 | A1 | 12/2009 | Balerdi Azpilicueta | |
| 2010/0065087 | A1 | 3/2010 | Grunert | |
| 2010/0101606 | A1 | 4/2010 | Grunert | |
| 2010/0212369 | A1 | 8/2010 | Grunert et al. | |
| 2010/0243002 | A1 | 9/2010 | Grunert et al. | |
| 2010/0257669 | A1 * | 10/2010 | Kennedy et al. | 4/348 |
| 2011/0302967 | A1 | 12/2011 | Grunert et al. | |

FOREIGN PATENT DOCUMENTS

| | | | | |
|---|---|---|---|---|
| CN | 1873084 | | 12/2006 | |
| CN | 101307557 | | 11/2008 | |
| DE | 2702639 | | 7/1978 | |
| DE | 3321245 | | 12/1984 | |
| DE | 3738031 | | 5/1989 | |
| DE | 3738031 | A1 | 5/1989 | |
| DE | 4035225 | | 5/1992 | |
| DE | 4212965 | | 10/1993 | |
| DE | 4303655 | | 8/1994 | |
| DE | 4333901 | | 2/1995 | |
| DE | 19600489 | | 7/1996 | |
| DE | 19511344 | | 10/1996 | |
| DE | 19639331 | | 3/1998 | |
| DE | 19943125 | | 11/2000 | |
| DE | 10002742 | | 6/2001 | |
| DE | 10002743 | A1 | 8/2001 | |
| DE | 102005014842 | A1 | 5/2006 | |
| DE | 102006006080 | | 8/2007 | |
| DE | 102006018469 | | 10/2007 | |
| DE | 102007016074 | A1 | 10/2008 | |
| EP | 430664 | A1 | 6/1991 | |
| EP | 0468573 | | 1/1992 | |
| EP | 0548386 | | 6/1993 | |
| EP | 0430664 | | 1/1996 | |
| EP | 0731204 | | 9/1996 | |
| EP | 0816549 | | 1/1998 | |
| EP | 1055767 | | 11/2000 | |
| EP | 1098028 | B1 | 7/2004 | |
| EP | 19360022 | A1 | 6/2008 | |
| FR | 2711153 | | 4/1995 | |
| GB | 2105452 | A * | 3/1983 | F26B 25/08 |
| KR | 2002031581 | A | 5/2002 | |
| WO | WO 2007062905 | | 6/2007 | |
| WO | 2008/119611 | A1 | 10/2008 | |
| WO | WO 2008119611 | | 10/2008 | |
| WO | 2009095312 | A1 | 8/2009 | |

OTHER PUBLICATIONS

National Search Report DE 10 2009 001 548.

National Search Report CN 201080011890.6.

Roemheld, "Betriebsanlietung Schnellverschlusskupplungen," www.roemheld, Jan. 2004.

Final Office Action issued in U.S. Appl. No. 12/682,283, dated Jun. 9, 2014, 27 pages.

Non-Final Office Action issued in related U.S. Appl. No. 13/002,787 dated Sep. 2, 2014, 33 pages.

Roemheld, "Quick-Disconnect Coupling," www.roemheld.com, issue 11-08 E, English translation.

Office Action issued in U.S. Appl. No. 12/682,283 dated Sep. 26, 2014.

English Translation of the First Office Action and Search Report for Chinese Application No. 201080014638.8, 3 pages, issued Nov. 2, 2012.

English Translation of the Third Office Action and Search Report for Chinese Application No. 201080014638.8, 4 pages, issued Oct. 8, 2013.

International Search Report PCT/EP2010/053258, issued Aug. 10, 2010, English translation.

National Search Report DE 10 2009 002 076.4, issued Apr. 1, 2009, English Translation.

Report of Examination of Eurasian Application No. 201070558, dated Jan. 23, 2013.

Office Action in U.S. Appl. No. 13/002,787, dated Dec. 16, 2014 (24 pages), including PTO-892 citing Dobbie et al., U.S. Patent No. 2,771,228, issued Nov. 20, 1956.

Office Action in U.S. Appl. No. 12/682,283, dated Jan. 14, 2015 (27 pages), including PTO-892 citing Kabeya et al., U.S. Patent No. 5,152,159, issued Oct. 6, 1992; Haas, U.S. Patent No. 404,192, issued May 28, 1889; and Sund, U.S. Patent No. 1,526,101, issued Feb. 10, 1925.

* cited by examiner

LAUNDRY DRYING UNIT HAVING A LINT SCREEN ARRANGED WITHIN A PROCESS AIR CIRCUIT AND A METHOD FOR OPERATING SAID LAUNDRY DRYING UNIT

This application is a U.S. National Phase of International Patent Application No. PCT/EP2010/052082, filed Feb. 19, 2010, which designates the U.S. and claims priority to German Patent Application No. DE 10 2009 001 548.5, filed Mar. 13, 2009, the entire contents of each of which are hereby incorporated by reference.

BACKGROUND OF THE INVENTION

The invention relates to a laundry-drying appliance having a lint screen and a method for operating such kind of laundry-drying appliance.

Laundry dryers are known in which for clearing away lint particles deposited on a lint screen a cleaning fluid that detaches said particles from the screen's surface and conveys them away therefrom is flushed across said screen. Said cleaning fluid consists of condensate water formed from moisture extracted from laundry during a drying process. A washing tank's fill levels can vary greatly because the amount of condensate water available for washing the lint particles off the lint screen depends on the dryer's respective load and setting. Because of the varying liquid level, with a valve located in a base of the washing tank being open for the same length of time, a varying amount of cleaning fluid for clearing away the lint particles from the lint screen will run out owing to the varying water pressure.

The cleaning fluid will be used also for conveying the lint particles from the lint screen into a repository after they have been cleared away from the screen. The lint particles and condensate water are separated again in said repository through filtering. The volume of lint particles already deposited from previous clearing operations and, briefly, the lint-laden liquid from the one in progress have to be accommodated in the repository during a clearing operation. Backwater that may even cause the lint-laden liquid in the repository to overflow can therein form in the repository.

WO 2008/119611 A1 describes a method and a device for cleaning a component, in particular a vaporizer of a condenser device, as well as washer/dryers or laundry dryers having said kind of device. For cleaning a component, particularly a vaporizer of a condenser device, located inside a process-air circuit of a washer/dryer or laundry dryer, condensate water obtained in the process-air circuit from the drying of damp laundry and collected in a condensate-water tray, is ducted toward a washing tank provided above the vaporizer and dispensed against the relevant component as a gush of water by the abrupt opening of said tank on the exiting side. All the condensate water stored in the washing tank is therein dispensed for cleaning the vaporizer, for which reason the condensate-water tray either has to be dimensioned as very large or the risk of the condensate-water tray's overflowing will have to be accepted.

BRIEF SUMMARY OF THE INVENTION

The object of the present invention is in a generic laundry-drying appliance to prevent cleaning fluid from overflowing while a component belonging to the laundry-drying appliance and requiring to be cleaned is being cleaned and to improve a receptivity for particles cleared from the component. A corresponding laundry-drying appliance and a method for operating it will be disclosed therein.

Said object is achieved according to the features of the respective independent claims. Preferred embodiment variants are described particularly in the dependent claims.

The laundry-drying appliance is fitted with a component that is located particularly inside a process-air circuit and requires cleaning and with a washing tank located above the component that requires cleaning, with its being possible for a cleaning fluid to be dispensed from the washing tank through a controllable valve against the component that requires cleaning and with the valve being able to be controlled, in particular actuated, on the basis of an amount of the cleaning fluid in the washing tank. Knowing the amount of the cleaning fluid at least approximately will enable the valve to be controlled such that during a cleaning process the desired amount of cleaning fluid can be released from the washing tank with a high degree of accuracy for the component requiring to be cleaned. In particular an amount of the cleaning fluid that is just sufficient for effectively clearing lint particles away can in that way be dispensed, as a result of which a collecting container (lint repository, condensate-water tray etc.) located fluidically downstream of the component requiring to be cleaned will be filled only with the smallest possible amount of cleaning fluid. That applies particularly in a case where the washing tank has been filled ahead of a cleaning process with a greater amount of cleaning fluid than is just sufficient for a cleaning process. That will reduce the risk of the collecting container's overflowing, as a result of which it can with an unchanged volume be designed for a larger amount of lint. There is the further advantage that controlling the valve's opening behavior as a function of the amount of cleaning fluid in the washing tank will allow the washing volume to be made uniform.

The valve can, for being actuated, be connected to a—particularly central—control device of the laundry-drying appliance. The control device can be equipped with a logic facility for calculating an amount of cleaning fluid in the washing tank. The control device can be functionally connected to at least one sensor, with its being possible for at least one measured value of the at least one sensor to serve as an input quantity for performing the calculation. The at least one sensor can include, for example, at least one load sensor, at least one moisture sensor (for example for measuring a temperature of process air being removed from a laundry drum), and at least one temperature sensor (for example for measuring a temperature or temperature difference on a heat exchanger) etc.

The valve can according to an embodiment variant be controllable as a function of a load of the laundry-drying appliance. A factor exploited therein is that the control equipment of some laundry dryers is already able to detect the load or, as the case may be, amount of the load in a laundry drum of the laundry-drying appliance. From the load values it is possible to at least roughly predict the amount of condensate water arising during a drying process. It is in turn possible to determine therefrom the amount of condensate water there will be in the washing tank for the clearing operation. The amount of cleaning fluid (amount of condensate water possibly dosed with fresh water) can with that solution be estimated with sufficient accuracy having recourse to a method known in principle, which makes particularly economical implementation possible.

Even more precise determining can advantageously be achieved when the valve is controllable as a function of a predetermined drying level or, as the case may be, dry condition (for example iron dry, wardrobe dry etc.). Knowledge of the drying level and hence of the residual moisture remaining in the laundry will enable the probable amount of cleaning fluid in the washing tank to be corrected accordingly.

More precise determining can advantageously be achieved also when the valve is controllable as a function of a preselected type of textile (wool, cotton etc.). That is because knowledge of the type of textile and hence of the residual moisture remaining in the laundry dependent on the specific textile will also enable the probable amount of cleaning fluid in the washing tank to be corrected.

More precise determining can alternatively or additionally be achieved by advantageously controlling the valve as a function of a drying time. The drying speed is substantially the same regardless of the load and of an initial residual moisture. From the drying time that has already elapsed it is hence possible to draw direct conclusions about the amount of fluid having already collected in the washing tank.

The valve can alternatively or additionally be controllable as a function of a measured fill level of the washing tank and/or collecting container. The fill level in the washing tank can be ascertained by way, for instance, of a magnetic float having a read-switch cascade, of Hall sensor sampling or magnetoresistive sensor sampling, or of direct level sampling using, for example, capacitive, optical, or acoustic sensors.

Another embodiment is for the valve to be controllable in terms of an opening duration. In other words the amount of the cleaning fluid provided for the clearing operation can be dosed through its being possible to set the valve's opening duration accordingly. It is therein advantageous for an opening process to be able to be performed very simply and quickly through the valve's being fully opened.

The valve can additionally or alternatively be controllable in terms of a flow cross-section. In other words the amount of the cleaning fluid provided for the clearing operation can be dosed through its being possible to set the flow cross-section released by the valve accordingly.

According to another embodiment the laundry-drying appliance can have a collecting container in the form of a condensate-water tray in which condensate water forming in the process-air circuit through the drying of damp laundry can be collected, with its being possible to feed said condensate water to the washing tank as the cleaning fluid. It can be fed there by means of a pump, for example.

Yet another embodiment is for a lint repository to be located fluidically upstream of the condensate-water tray, with its being possible for the lint repository to have a drain fitted with a lint-retaining element. The lint-retaining element can have, for example, a filter screen. Blocking of the condensate-water tray and a pump that may be connected thereto can be prevented by the lint repository.

To achieve a compact structural design it can be advantageous for the lint repository to be integrated in the condensate-water tray as a pre-chamber. The lint repository can then be regarded as a pre-chamber of the condensate-water tray.

So that the lint particles can be removed conveniently and also by an end customer in a problem-free manner it can be advantageous for the lint repository to be detachable.

The object is achieved also by means of a method for operating the above-described laundry-drying appliance, with said method having at least the following steps:

(a) Ascertaining an amount of the cleaning fluid in the washing tank and (b) as a function of the ascertained amount of cleaning fluid, controlling the valve for releasing the cleaning fluid from the washing tank onto the component requiring to be cleaned.

It can be advantageous if at step (b), controlling the valve includes opening it for an opening duration that is a function of the ascertained amount of cleaning fluid.

It can also be advantageous if at step (b), controlling the valve includes opening it having a flow cross-section that is a function of the ascertained amount of cleaning fluid.

It has proved advantageous for the valve to be kept open until an amount of up to approximately 0.5 to 1 l of the cleaning fluid has been released onto the component requiring to be cleaned. That will give a good cleaning performance accompanied by a low consumption of cleaning fluid, and there will be no risk of the collecting container's overflowing.

BRIEF DESCRIPTION OF THE DRAWINGS

The invention is described schematically in more detail in the figures below with the aid of an exemplary embodiment/exemplary embodiments. For greater clarity, elements that are the same or have the same effect can have been assigned the same reference numerals/letters.

DETAILED DESCRIPTION OF EXEMPLARY EMBODIMENTS OF THE PRESENT INVENTION

Figure 1:
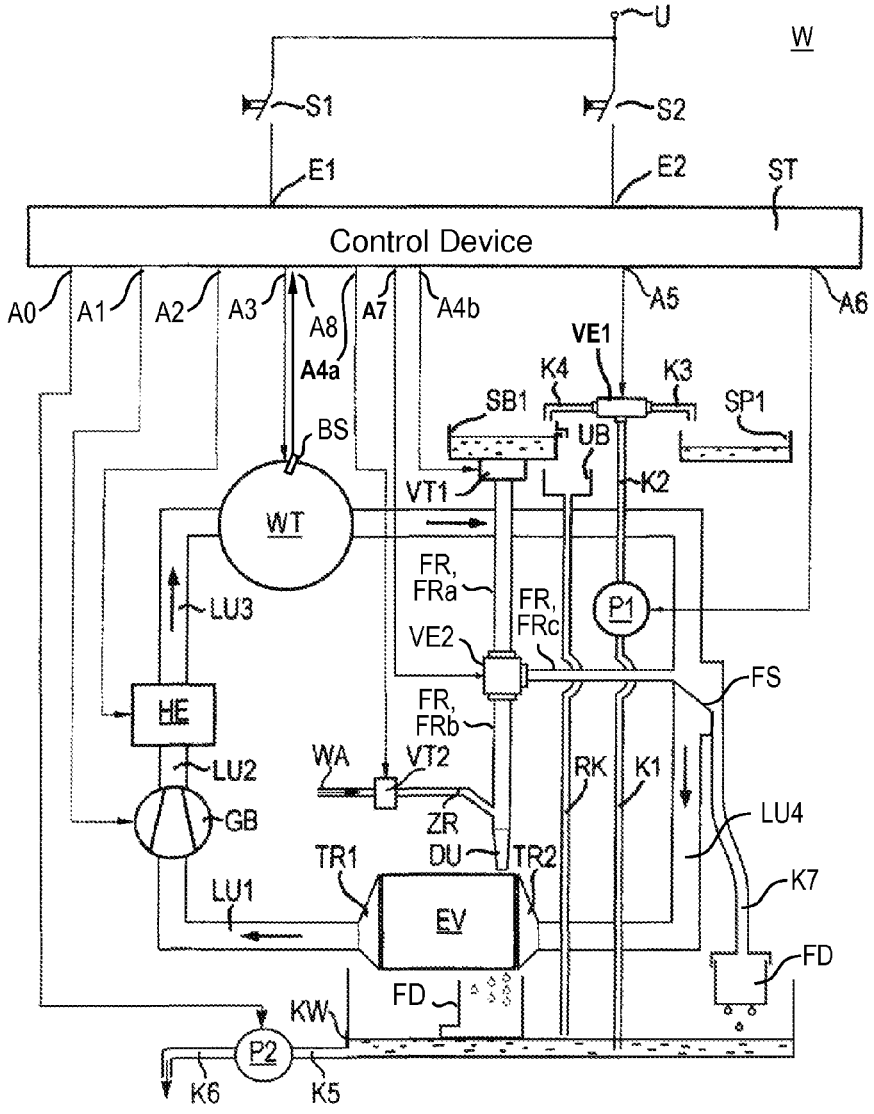
FIG. 1 is a schematic sketch of a laundry-drying appliance.

FIG. 1 shows a laundry-drying appliance W, but with only the parts thereof being illustrated here that will help understand the present explanation. Among said parts are especially a washing or laundry drum WT containing damp laundry requiring to be dried and a process-airstream arrangement—which is linked to said drum and considered in more detail below—through which process air flows in the direction of the arrows shown in FIG. 1. Laundry drum WT and the process-airstream arrangement together form a process-air circuit.

The process-airstream arrangement includes a number of process-air channels LU1, LU2, LU3, and LU4 as well as devices linked thereto, namely a blower GB, a heating device HE, and a vaporizer EV of a condenser device not shown in further detail here. Vaporizer EV is therein connected on the exiting side via a funnel-shaped terminal TR1 serving as a transitional part to one end of process-air channel LU1 to which cold, dry process air is fed and which is connected by its other end to an input terminal of blower GB. Said blower GB is connected on the output side via process-air channel LU2 to the input side of heating device HE, which is connected on the output side by process-air channel LU3 to the input side of washing or laundry drum WT for feeding in what is now hot, dry process air. For ducting away hot, moist process air removed from damp laundry that is to be dried in it, washing or, as the case may be, laundry drum WT is connected on the output side by process-air channel LU4 and a funnel-shaped terminal TR2 that adjoins it and serves likewise as a transitional part to the entry side of vaporizer EV. The moisture in the hot, moist process air fed in through process-air channel LU4 from washing or, as the case may be, laundry drum WT is condensed in said vaporizer EV. In the form of water droplets, as indicated in FIG. 1, the condensate water consequently forming in vaporizer EV enters a collecting container that is located beneath vaporizer EV and has the form of a condensate-water tray KW, in which it is collected.

The condensate water having collected in condensate-water tray KW has to be ducted away from it so it will not overflow. Condensate-water tray KW is for that purpose connected in the present instance by a connecting channel K1 to the input side of an electric pump P1, which can be a impeller pump, for example. Pump P1 is connected on the output side by a connecting channel K2 to the input side of a first distributor VE1, which in the present instance may be a controllable two-way valve. The relevant first distributor or, as the case may be, two-way valve VE1 has two input terminals one of which is connected to a connecting channel K3 and the other of which is connected to a connecting channel K4.

The purpose of connecting channel K3 is to feed condensate water dispensed through it and pumped up from condensate-water tray KW by means of pump P1 into a separate storage container SP1 provided in the top region of the washer/dryer or laundry dryer containing the device according to the invention. Said storage container SP1 can be, for example, a storage container that is manually removable from the washer/dryer or laundry dryer containing the described device and by means of which the condensate water pumped up into it from condensate-water tray KW can be disposed of.

Connecting channel K4 serves to dispense condensate water fed to it by the first distributor or, as the case may be, two-way valve VE1 on the output side to a washing tank SB1. Said washing tank SB1 which in the washer/dryer or laundry dryer containing the device shown is located as close as possible to the top of said dryer and which can have the same storage capacity as condensate-water tray KW or storage container SP1, for example for holding 2 liters of condensate water, is for safety's sake—as shown—provided with an overflow arrangement through which any condensate water overflowing from washing tank SB1 will reach an overflow container UB that via a return channel RK has a direct connection to condensate-water tray KW and which is able to feed condensate water that reaches it directly into condensate-water tray KW.

The condensate water having collected in condensate-water tray KW can on the other hand be pumped away through a connecting channel K5 by means of an electric pump P2, which can likewise be, for example, an impeller pump, into a connecting channel K6 that can lead to a waster-water-disposal arrangement such as a water drainpipe.

Washing tank SB1 is connected by means of its output or, as the case may be, exiting side via a normally closed first valve VT1, which can be opened by being actuated or, as the case may be, controlled, to a downpipe FR. Located in downpipe FR is a distributor VE2 whose input side is connected to washing tank SB1. Distributor VE2 is in the present instance a controllable two-way valve. Proceeding from a non-branched section Fra, downpipe FR is divided at distributor VE2 into a first branch FRb and a second branch FRc. First branch FRb leads to an entry region of vaporizer EV, whereas second branch FRc leads to process-air channel LU4. Expressed more precisely, second branch FRc leads to a top edge of an air-permeable lint screen FS arranged in process-air channel LU4 and serving to remove lint and other particles from the moist, warm process air.

First described below is the functioning of downpipe FR for clearing vaporizer EV, which is to say non-branched part FRa between first valve VT1 and second distributor VE2 and first branch FRb: Downpipe FR having a relatively large cross-section has in this connection a drop preferably of about 500 to 600 mm for the condensate water requiring to be dispensed from washing tank SB1 as a gush. Downpipe FR or, as the case may be, its first branch FRb is provided at its—in FIG. 1—bottom end with a washing nozzle DU that is arranged statically and has an approximately 6-to-10-mm-wide and roughly oval exiting region extending across the entire width of vaporizer EV, which nozzle is located with the longitudinal center of its exiting region a specified distance which here is approximately 10 to 50 mm from the entry region—on the right in FIG. 1—of vaporizer EV for hot, moist process air. That arrangement of downpipe FR or, as the case may be, FRa, FRb and washing nozzle DU will enable condensate water exiting washing tank SB1 when first valve VT1 has been opened to be dispensed as a gush of water against a vaporizer region located preferably only the specified distance from the region where process air enters vaporizer EV. The dimensions of the transfer opening of first valve VT1 and of the cross-section of downpipe FR or, as the case may be, FRa, FRb and washing nozzle DU have therein preferably been selected such that the condensate water having collected in washing tank SB1—so about 2 liters of condensate water according to the example assumed above—will be dispensed against vaporizer EV as a gush of water within a very short time span of 1 to 2 seconds. Dispensing such a gush of water, meaning at a speed of, for example, up to 0.5 to 2 liters in 2 seconds and preferably immediately after the damp laundry located in the washing or, as the case may be, laundry drum WT for the purpose of being dried has undergone a drying process, will enable lint particles and other impurities that have been ducted to the cited process air-entry region of vaporizer EV and beyond by process-air channel LU4 and funnel-shaped terminal TR2 to be washed away particularly effectively from where they have been ducted. To achieve broad uniformity in the amount of water dispensed as a gush of water between when it starts and when it stops being dispensed against vaporizer EV, it has proved expedient for downpipe FR, FRb to have a region to which washing nozzle DU also belongs and which has been narrowed relative to the cross-section of the exiting region of washing tank SB1. It is, though, necessary to ensure therein that the previously indicated minimum amount of condensate water per unit of time is made available for washing vaporizer EV. In addition to previously cited gushed dispensing of the condensate water in each case contained in washing tank SB1 against vaporizer EV it is possible also to dispense standard, pressurized mains water against the vaporizer for cleaning. Provided therefor is a water-intake pipe WA to which the relevant pressurized mains water is fed. Connected to the dispensing side of relevant water-intake pipe WA is, according to FIG. 1, a second valve VT2 that can be, for example, a standard shutoff valve. Provided on the exiting side of second valve VT2 is a water-outlet pipe ZR which in the lower region of downpipe FR projects thereinto, thus according to FIG. 1 above washing nozzle DU of relevant downpipe FR or, as the case may be, FRb. The mains water can in that way be dispensed as a supplement to the condensate water gushed from washing tank SB1 for cleaning vaporizer EV, or said water can also be dispensed by itself against vaporizer EV for cleaning it. The condensate water having in each case collected in washing tank SB1 can be pumped away with the aid of cited pumps P1 and P2 to prevent condensate-water tray KW from overflowing. It is therein clear that of the condensate water having in each case collected in condensate-water tray KW only a portion corresponding to the capacity of washing tank SB1 and/or storage container SP1 is to be pumped away by means of pump P1. The portion of condensate water which exceeds that and is dispensed into condensate-water tray KW is to be pumped away into the cited drainage arrangement by means of pump P2. Vaporizer EV can be cleaned most excellently by means of that especially additional dispensing of mains water for cleaning it. The relevant dispensing of mains water for cleaning vaporizer EV is of particular significance in the case especially of a washer/dryer, which has in any event a mains-water-intake facility and a mains-water-outlet facility.

Combining the dispensing of pressurized mains water and the condensate water gushed from washing tank SB1 will enable vaporizer EV to be cleaned even more efficiently than when only mains water or only condensate water is dispensed against said vaporizer EV. The appliance shown in FIG. 1 can, though, on the other hand be used also in a laundry dryer in which only damp laundry is to be dried. The relevant laundry dryer—which usually manages without any connections to a water intake or water outlet—can in that case be supplied with mains water in water-intake pipe WA, meaning it can be connected to an appropriate mains-water terminal; connecting channel K6 must then be connected to a waster-water-disposal arrangement. In terms of cleaning vaporizer EV with condensate water from washing tank SB1 and, where applicable, mains water, the same conditions will then prevail in a laundry dryer as those explained earlier in connection with a washer/dryer.

A lint repository FD is connected fluidically upstream of condensate-water tray KW in the embodiment variant shown. Lint repository FD has a drain part (not illustrated) through which condensate water brought into lint repository FD can continue running into condensate-water tray KW. The drain part has a lint-retaining element in the form of a lint screen (not illustrated) by means of which lint particles are held back in lint repository FD. Pumps P1 and P2 are prevented thereby from becoming blocked with the lint particles. Lint repository FD is integrated in condensate-water tray KW and hence serves as a pre-chamber for condensate-water tray KW as such. Lint repository FD can be detached for easy removal of the lint particles deposited in lint repository FD.

Described now is the functioning mode of downpipe FR for clearing lint screen FS, meaning non-branched part FRa and second branch FRc: With distributor VE2 is a suitable position, condensate water is now through opening of first valve VT1 ducted from washing tank SB1 through non-branched part FRa and on through second branch FRc to lint screen FS. The condensate water then flows from top to bottom across lint screen FS and, in flowing, carries away lint and other particles that have attached themselves to lint screen FS during a drying process. The condensate water then containing the lint particles runs through another connecting channel K7 to lint repository FD and on from there to condensate-water tray KW. The amount of condensate water totaling 21 used for clearing vaporizer EV will not, though, be needed for clearing lint screen FS. Rather it is the case that when there are large amounts of water (more than 0.5 l) and when a large amount of lint particles has been deposited in the lint repository it can happen that lint repository FD is no longer able within a short period of time to accommodate the amount of fluid produced during clearing. The result will be overflowing of lint repository FD with consequent disadvantageous distributing of lint-laden condensate water into condensate-water tray KW. So to be able to accommodate as many lint particles in the repository as possible from as many clearing processes as possible, performed particularly on the lint screen, the amount of fluid for a clearing process must not to be too large. First valve VT1 will when lint screen FS is being cleared therefore be actuated in such a way that only about 0.5 to 1 l of the cleaning fluid will be released. First valve VT1 can for that purpose be opened for an opening duration dependent on the amount of cleaning fluid in washing tank SB, which duration will allow the passage of roughly 0.5 to 1 l of the cleaning fluid. The washing amount of 0.5 l will allow, for example, an (in the damp state compressed) amount of lint from approximately 50 drying processes to be accommodated in the lint repository. The amount of cleaning fluid is therein estimated from a load in laundry drum WT.

For estimating, laundry-drying appliance W is fitted on laundry drum WT with a load sensor BS that substantially senses a weight of the laundry in laundry drum WT, particularly at the beginning of a drying process. For said estimating it is optionally possible additionally to take account of information about an initial degree of laundry dampness, a desired drying level of the laundry, a past duration of the drying process, moisture values of the process air, and/or temperature values measured on a heat exchanger. At least one fill-level sensor could alternatively be attached to the washing tank and/or condensate-water tray KW.

The amount of the cleaning fluid in washing tank SB is first ascertained by means of, for example, a control device ST described in more detail further below taking account of at least one measured value sensed by load sensor BE and/or of a past drying time. For releasing the cleaning fluid from the washing tank against the component requiring to be cleaned, first valve VT1 is then controlled or, as the case may be, switched as a function of the ascertained amount of the cleaning fluid. A correlation between the amount of cleaning fluid stored in the washing tank and an opening characteristic of first valve VT 1 (for example an opening duration) can be stored via, for example, a characteristics field in control unit ST. The characteristics field can have, for example, a characteristic that establishes a relationship between a load and/or fill level in washing tank SB on the one hand and an opening duration and/or flow cross-section of first valve VT1 on the other. The flow cross-section can be set by way of, for example, an opening height of first valve VT1. Control device ST can also switch distributor VE2 onto lint screen FS for clearing it.

Control device ST is provided for controlling the various devices shown in FIG. 1 that were mentioned above. Said control device ST can include, for example, a microcontroller having its own software or a microprocessor controller having a CPU, a ROM memory containing an operating program and working program, and a main memory RAM as well as interface circuitry to which actuating signals are fed on the input side and which on the output side allow control signals to be sent to the various devices belonging to the appliance shown in FIG. 1.

Control device ST has according to FIG. 1 for example two input terminals E1 and E2 to which switch S1 or, as the case may be, S2 is connected, each of which is applied to a voltage terminal U that can carry a voltage of, for example, +5V. Control device ST has on the output side in the present instance for example nine output terminals A0, A1, A2, A3, A4*a*, A4*b*, A5, A6, and A7 as well as an input terminal A8 shown by way of example.

Output terminal A0 is connected to a control input of pump P2 through whose operation condensate water that has collected in condensate-water tray KW can be pumped away through connecting channels K5 and K6 to a waste-water-accommodating facility such as a drain pipe.

Output terminal A1 of control device ST is connected to a control input of blower GB which can be activated or deactivated by means of control signals fed to it at said control input.

Output terminal A2 of control device ST is connected to a corresponding control input of heating device HE which can be activated or deactivated by means of control signals fed to it at said control input.

Output terminal A3 of control device ST is linked by way of a connection to be understood only as being operative to washing or, as the case may be, laundry drum WT that can be made to turn or brought to a halt via control signals sent over the relevant connection. That means that the relevant control signals from output terminal A3 of control device ST are fed to an electric drive motor connected to washing or, as the case may be, laundry drum WT.

Output terminal A4*a* of control device ST is connected to an actuating input of second valve VT2 which has been either closed or fully opened by means of control signals fed to it from output terminal A4*a* of control device ST. It is therefore possible for second valve VT2, which may be, as mentioned above, preferably an electrically actuated locking valve, usually to be closed and able to be fully opened by means only of a control signal (corresponding for example to a binary signal "1") fed from output terminal A4*a* of control device ST.

Output terminal A4*b* of control device ST is connected to an actuating input of first valve VT1 which has been either closed or fully opened by means of control signals fed to it from output terminal A4*b* of control device ST. It is therefore possible for first valve VT1 usually to be closed and able to be fully opened by means only of a control signal (corresponding for example to a binary signal "1") fed from output terminal A4*b* of control device ST.

Output terminal A5 of control device ST is connected to a control or, as the case may be, actuating input of first distributor or, as the case may be, two-way valve VE1. By means of control signals fed via said connection to first valve or, as the case may be, two-way valve VE1, the relevant first valve or, as the case may be, two-way valve VE1 can feed condensate water ducted to it by means of pump P1 from condensate-water tray KW water either to connecting channel K3 or to connecting channel K4 or block feeding of such kind to both connecting channels K3 and K4.

Output terminal A6 of control device ST is connected to a control input of cited pump P1 which in response to control signals fed to it over said connection can be either made to start pumping or brought to a halt.

Output terminal A7 of control device ST is connected to a control or, as the case may be, actuating input of second distributor VE2. By means of control signals fed via said connection to valve VE2, the relevant valve VE2 can feed cleaning fluid released from washing tank SB1 into either first branch FRb or second branch FRc of downpipe FR.

An output terminal of a load sensor BS is connected to an input terminal A8 of control device ST so that control device ST can sense measured values of load sensor BS for determining an amount of washing water in the washing-water container.

Be it noted regarding above-considered control device ST with its input terminals E1 and E2 and output terminals A0 to A7 that for example standard drying of damp laundry in washing or, as the case may be, laundry drum WT will be initiated and performed by the closing of switch S1 connected to input terminal E1 of control device ST and that dispensing condensate water from abruptly opened washing tank SB1 as a gush of water against vaporizer EV will be controlled by the closing of switch S2 connected to input terminal E2 of control device ST. It can therein be possible for the two switches 51 and S2 to be actuated only in such a way that just one of the two switches 51 and S2 can be actuated at a time. Relevant switches 51 and S2 can furthermore each be formed by means of a momentary-contact switch.

The condensate water in washing tank SB1 can be provided from condensate-water tray KW for example automatically under program control preferably during a drying process, though also after the completion of such, or selectively by intervening manually in the program control of the washer/dryer or laundry dryer containing the device described. Control device ST could in the event of a manual intervention of such kind in the program control be connected by means of a further input to voltage terminal U via a further switch (not shown).

That clearing process can be performed using the relevant condensate water possibly once or repeatedly as applicable. The condensate water that has collected again in condensate-water tray KW must then for that purpose in each case be pumped up into washing tank SB1 from where it will thereupon be gushed once more against the vaporizer. The condensate water having collected in condensate-water tray KW must on completion of the cleaning or, as the case may be, clearing process either be ducted away into an existing waste-water system or pumped into washing tank SB2, which will then need emptying manually.

Such kind of clearing process and hence cleaning of vaporizer EV can in addition to applying the above-considered clearing process be carried out using pressurized mains water fed to relevant vaporizer EV via water-intake pipe WA, second valve VT2, and water-outlet pipe ZR. Control device ST will in that case alternatively or additionally to sending a control signal that opens valve VT1 send a corresponding control signal to second valve VT2 for opening it.

Figure 2:
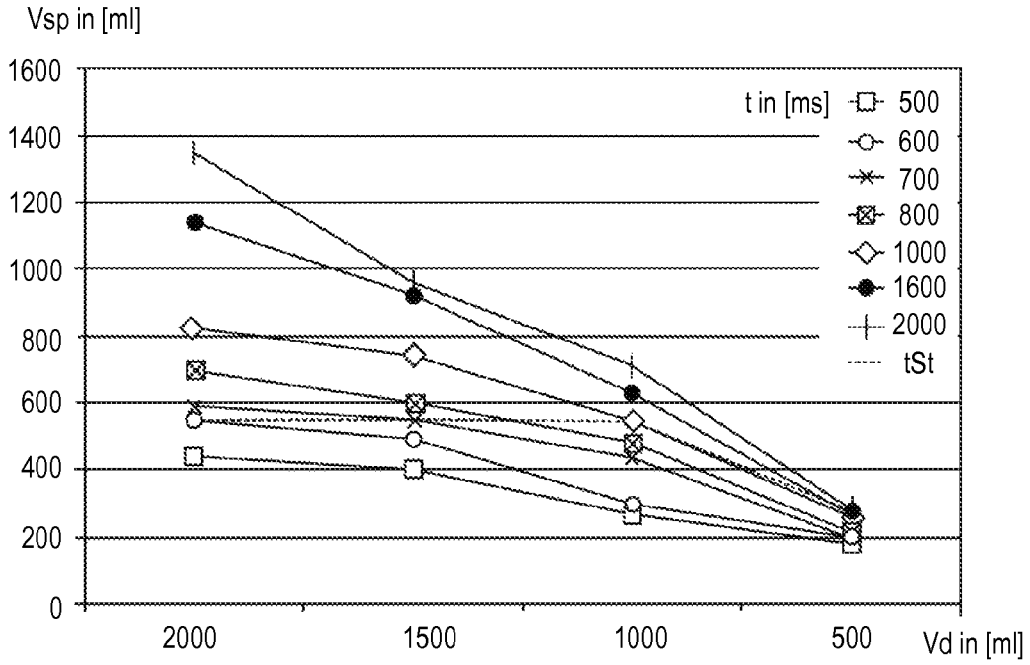
FIG. 2 shows an amount of cleaning fluid dispensed from a washing-water container of the laundry-drying appliance shown in FIG. 1 plotted against an amount of cleaning fluid initially stored in the washing tank for different opening durations of an associated valve.

FIG. 2 shows an amount of cleaning fluid (here quantified as a washing volume Vsp) in ml dispensed with valve VT1 open from washing-water container SB shown in FIG. 1 plotted against an amount of cleaning fluid (here quantified as a storage volume Vb) in ml stored in washing tank SB prior to a clearing process for different opening durations t of valve VT1.

The plotted graph shows that washing volume Vsp depends significantly on storage volume Vd (deducible from the fill level, for instance) because the pressure of the column of washing water differs with differing storage volume Vb. Thus a washing volume Vsp of approximately 1,350 ml will run out when valve VT1 has an opening duration of, for instance, t=2,000 ms (2 s) and the storage volume Vd is 2,000 ml (2 l), but the washing volume Vsp running out will be approximately only 750 ml when the storage volume Vd is 1,000 ml. The washing volume Vsp can be evened out to in this case about 550 ml by having an opening duration tSt=tSt (Vd) of valve VT1 controlled as a function of storage volume Vd (dashed curve). Opening duration tSt can therein particularly be shorter the greater storage volume Vd is.

The present invention is of course not limited to the exemplary embodiment shown.

Hence the arrangement shown in FIG. 1 is just a functional sketch and does not need to include, for example, any actual dimensions or spatial dispositions. For example sections FRa, FRc of downpipe FR that lead from washing tank SB1 to lint screen FS can be arranged as running continuously downward, so having neither a mutual right angle nor a horizontal section, as a result of which an adequate flow speed can be maintained at lint screen FS. Nor is the location of lint screen FS limited to a vertical section of process-air channel LU4 or to process-air channel LU4 as such.

A fresh-water supply can furthermore be set up also for the washing tank to achieve a minimum amount of washing water for the eventuality that the fill level in the washing tank falls below an amount necessary for adequate cleaning.

Valve VT1 and distributor VE2 of the downpipe can be embodied also as a single valve so that the downpipe to the vaporizer and the feed pipe to the lint screen will be fluidically separated.

It is generally unnecessary for any of the laundry-drying appliance's components other than the lint screen to be cleaned by means of condensate water or, as the case may be, the device shown. For example a laundry-drying appliance can be provided that no longer makes any provision for cleaning the vaporizer because the lint particles will already be trapped by the lint screen to an extent adequate for a long period of operation.

Another two-way valve which alternatively ducts condensate water K to two-way valve VE1 or a waste-water disposal facility could furthermore be arranged instead of second pump P2 behind pump P1 and in front of two-way valve VE1.

LIST OF REFERENCES

A0, A1, A2, A3 A4*a*, A4*b*, A5, A6 Output terminals
BS Load sensor
E1, E2 Input terminals
EV Vaporizer
FD Lint repository
FR Downpipe
FRa Non-branched part of the downpipe
FRb, FRc Branched part of the downpipe
FS Lint screen
GB Blower
HE Heating device
K1, K2, K3, K4, K5, K6, K7 Connecting channels
KW Condensate-water tray
LU1, LU2, LU3, LU4 Process-air channels
P1, P2 Pump
RK Return channel
S1, S2 Switch
SB1 Washing tank
SO Tappet
SP1 Storage container
ST Control device
T Opening duration
TE Closure plate
TR1, TR2 Funnel-shaped terminals (transitional parts)
U Voltage terminal
UB Overflow container
Vd Storage volume
VE1, VE2 Distributor
VT1, VT2 Valve
Vsp Washing volume
WA Water-intake pipe
WT Laundry drum
W Laundry-drying appliance
ZR Water feedpipe

The invention claimed is:

1. A laundry-drying appliance, comprising:

a process air circuit structured to circulate process air through the laundry-drying appliance;

a component arranged in the process air circuit;

a washing tank provided above the component, the washing tank structured to store and dispense a cleaning fluid; and a controllable valve configured to control and dispense a flow of cleaning fluid from the washing tank downward onto the component for cleaning the component, said valve being controllable based on an amount of cleaning fluid in the washing tank.

2. The laundry-drying appliance of claim 1, wherein the valve is controllable as a function of a load of the laundry-drying appliance.

3. The laundry-drying appliance of claim 1, wherein the valve is controllable as a function of a set drying level of the laundry-drying appliance.

4. The laundry-drying appliance of claim 1, wherein the valve is controllable as a function of a drying time.

5. The laundry-drying appliance of claim 1, wherein the valve is controllable as a function of a fill-level height of the washing tank.

6. The laundry-drying appliance of claim 1, wherein the valve is controllable in terms of an opening duration and/or flow cross-section.

7. The laundry-drying appliance of claim 1, further comprising a condensate-water tray for collecting condensate water which is produced in the process air circuit when drying damp laundry, the condensate water being fed to the washing tank for use as the cleaning fluid.

8. The laundry-drying appliance of claim 7, further comprising a lint repository located fluidically upstream of the condensate-water tray, the lint repository having a drain fitted with a lint-retaining element.

9. The laundry-drying appliance of claim 8, wherein the lint repository is integrated in the condensate-water tray.

10. The laundry-drying appliance of claim 8, wherein the lint repository is constructed to allow detachment thereof.

11. The laundry-drying appliance of claim 1, further comprising:

a control device configured to operate the valve; and at least one sensor operably connected to the control device, said control device including a logic facility configured to calculate an amount of cleaning fluid in the washing tank in response to at least one measured value measured by the at least one sensor, the at least one measured value serving as an input quantity for performing the calculation.

12. A method for operating a laundry-drying appliance, comprising:

ascertaining an amount of cleaning fluid in a washing tank with a sensor; and releasing cleaning fluid from the washing tank to a component positioned in a process air circuit by controlling a valve as a function of the ascertained amount of cleaning fluid for cleaning the component.

13. The method of claim 12, wherein controlling the valve includes opening the valve for an opening duration as a function of the ascertained amount of cleaning fluid.

14. The method of claim 12, wherein controlling the valve includes opening the valve to a flow cross-section, the flow cross-section set as a function of the ascertained amount of cleaning fluid.

15. The method of claim 12, wherein controlling the valve includes opening the valve until up to approximately 0.5 L to 1 L of the cleaning fluid has been released to the component to be cleaned.

* * * * *